US006813457B2

(12) United States Patent
Yoshiki

(10) Patent No.: US 6,813,457 B2
(45) Date of Patent: Nov. 2, 2004

(54) TONER SCATTER PREVENTING DEVICE AND IMAGE FORMING APPARATUS INCLUDING THE SAME

(75) Inventor: Shigeru Yoshiki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 12 days.

(21) Appl. No.: 10/315,936

(22) Filed: Dec. 11, 2002

(65) Prior Publication Data

US 2003/0123898 A1 Jul. 3, 2003

(30) Foreign Application Priority Data

Dec. 11, 2001 (JP) ..... 2001-377256

(51) Int. Cl.[7] ..... G03G 21/20
(52) U.S. Cl. ..... 399/92; 399/99
(58) Field of Search ..... 399/92, 93, 98, 399/99, 222, 252; 428/110.4

(56) References Cited

U.S. PATENT DOCUMENTS

| | | | |
|---|---|---|---|
| 5,255,059 | A | 10/1993 | Kai et al. |
| 5,416,568 | A | 5/1995 | Yoshiki et al. |
| 5,442,430 | A | 8/1995 | Ishii et al. |
| 5,455,662 | A | 10/1995 | Ichikawa et al. |
| 5,493,365 | A | 2/1996 | Matsui et al. |
| 5,500,719 | A | 3/1996 | Ichikawa et al. |
| 5,557,382 | A | 9/1996 | Tatsumi et al. |
| 5,627,631 | A | 5/1997 | Ichikawa et al. |
| 5,765,079 | A | 6/1998 | Yoshiki et al. |
| 5,794,108 | A | 8/1998 | Yoshizawa et al. |
| 5,822,663 | A | 10/1998 | Ichikawa et al. |
| 5,828,935 | A | 10/1998 | Tatsumi et al. |
| 5,909,610 | A | 6/1999 | Yoshiki et al. |
| 5,918,090 | A | 6/1999 | Ichikawa et al. |
| 5,970,290 | A | 10/1999 | Yoshiki et al. |
| 6,075,963 | A | 6/2000 | Ichikawa et al. |
| 6,289,195 | B1 | 9/2001 | Ichikawa et al. |
| 6,418,293 | B2 | 7/2002 | Ichikawa et al. |

FOREIGN PATENT DOCUMENTS

| | | |
|---|---|---|
| JP | 8-185046 | 7/1996 |
| JP | 10-274883 | 10/1998 |

OTHER PUBLICATIONS

U.S. patent application Ser. No. 10/756,253, Yoshiki, filed Jan. 14, 2004.
U.S. patent application Ser. No. 10/058,352, Yoshiki, filed Jan. 30, 2002.
U.S. patent application Ser. No. 10/173,981, Ichikawa et al., Jun. 19, 2002.
U.S. patent application Ser. No. 10/452,295, Kawahara et al., filed Jun. 3, 2003.
U.S. patent application Ser. No. 10/459,491, Tanimoto, filed Jun. 12, 2003.

*Primary Examiner*—Robert Beatty
(74) *Attorney, Agent, or Firm*—Oblon, Spivak, McClelland, Maier & Neustadt, P.C.

(57) ABSTRACT

An image forming apparatus of the present invention includes a toner scatter preventing device for a developing device configured to develop a latent image formed on an image carrier with toner. The toner scatter preventing device includes an exhausting section for exhausting air inside the developing device via an exhaust passage extending from the top of developing device. Air is sucked out of the developing device to thereby generate a stream of air that sucks air around an opening for development formed in the developing device. A suction port is formed in the developing device and communicated to the exhaust passage. The suction port is positioned outside of an image forming width assigned to the developing device.

13 Claims, 11 Drawing Sheets

TONER SCATTER PREVENTING DEVICE AND IMAGE FORMING APPARATUS INCLUDING THE SAME

BACKGROUND OF THE INVENTION

1. Field of the Invention

The present invention relates to a device for preventing toner from flying out of a developing device and a copier, printer, plotter, facsimile apparatus or similar electrophotographic image forming apparatus including the same.

2. Description of the Background Art

It is a common practice with an image forming apparatus to develop a latent image formed on an image carrier with a developer containing toner, transfer the resulting toner image to a sheet or recording medium, and then fix the toner image on the sheet for thereby producing a copy or a print. The problem with this type of image forming apparatus is that part of the toner not contributed to development flies out of a developing device via an opening for development. Such toner contaminates the inside of the apparatus or deposits on the image carrier and therefore on the sheet, lowering image quality. Moreover, the toner contaminates the portion of the developing device around the above opening and smears a person in the event of maintenance.

In light of the above, Japanese Patent Laid-Open Publication No. 10-3220, for example, discloses a toner scatter preventing device including a filter case on which a fan and a filter are mounted. A developing device adjoins a photoconductive element or image carrier and is formed with a suction port. The filter case with the fan and filter is mounted on the developing device around the suction port. The fan sucks air out of the developing device via the suction portion and discharges it via an exhaust port. As a result, air around the drum flows into the developing device via an opening for development also formed in the developing device, preventing toner from being scattered around via the opening. At the same time, the filter collects toner from air flowing toward the exhaust port.

However, the toner scatter preventing device described above has the following problems left unsolved. The toner collected by the filter accumulates on the filter little by little and obstructs the stream of air being sucked by the fan, thereby preventing the device from performing the expected operation. Further, the toner accumulating on the filter forms large masses in due course of time and drops into the developing device via the suction portion. Such masses of toner deposit on the drum and make the density of a toner image irregular, i.e., lower image quality.

Particularly, when use is made of toner with a small grain size for enhancing image quality including dot reproducibility and tonality, the toner implemented as fine powder is apt to fly about. Therefore, when an arrangement is made to suck the toner flying out of a developing device, the toner is collected in a great amount due to its small grain size and stops up a filter or fills up a tank in a short period of time. This results in the need for frequent maintenance including monitoring the time for replacement of the filter and that of the tank. Consequently, the above arrangement increases maintenance loads although enhancing image quality.

To solve the above problem, Japanese Patent Application No. 2001-168354, for example, proposes a toner scatter preventing device applicable to an image forming apparatus of the type using toner with a small grain size and constructed to reduce the amount of toner to fly about for thereby extending the interval between consecutive times of maintenance. The toner scatter preventing device is generally made up of exhausting means, toner collecting means, and toner storing means. The exhausting means exhausts air inside a developing device via an exhaust passage while the toner collecting means collects toner entrained by such air. The toner so collected is stored in the toner storing means without dropping into the developing device, so that a filter, for example, is prevented from being stopped up. In this case, use is made of a two-ingredient type developer containing toner having a weight-mean grain size of 65 $\mu$m or below.

In the toner scatter preventing device described above, when the exhausting means exhausts air inside the developing device, air around an opening for development is sucked into the developing device while entraining flying toner into the developing device. More specifically, air is sucked into the developing device via the opening for development intervening between a developing roller and a case. However, air around opposite edges of the developing roller turns round into the developing device as well. This part of air makes the stream of air weaker at the opposite edges than at the center with the result that the opposite edges are more contaminated by scattered toner than the center. Although total suction may be intensified, it is difficult to intensity the stream of air at the opposite ends of the developing roller.

Application No. 2001-168354 stated above additionally proposes a configuration in which a suction port is positioned outside of and below the developing device, so that toner flying out of the developing device is sucked via the suction port. In this configuration, suction is intensified at portions outside of a sheet conveying range to thereby more intensely suck the toner flying out of the developing device. This, however, brings about another problem that the toner accumulates on the bottom of the developing device little by little and deposits on the image carrier in due course of time, smearing the resulting images. Moreover, this kind of scheme does not prevent the toner from flying out of the developing device, but simply sucks the toner flown out of the developing device.

Technologies relating to the present invention are also disclosed in, e.g., Japanese Patent Laid-Open Publication No. 8-185046 and 10-274883.

SUMMARY OF THE INVENTION

It is an object of the present invention to provide a toner scatter preventing device capable of intensifying, when sucking air out of a developing device to thereby suck air around an opening for development formed in the developing device, intensifying air streams at both ends of the opening for thereby protecting the ends from smearing.

It is another object of the present invention to provide an image forming apparatus including a toner scatter preventing device with the above capability.

A toner scatter preventing device of the present invention is applied to a developing device configured to develop a latent image formed on an image carrier with toner. The toner scatter preventing device includes an exhausting section for exhausting air inside the developing device via an exhaust passage extending from the top of the developing device. An air stream generating device sucks air out of the developing device to thereby generate a stream of air that sucks air around an opening for development formed in the developing device. A suction port is formed in the developing device and communicated to the exhaust passage. The suction port is positioned outside of an image forming width assigned to the developing device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
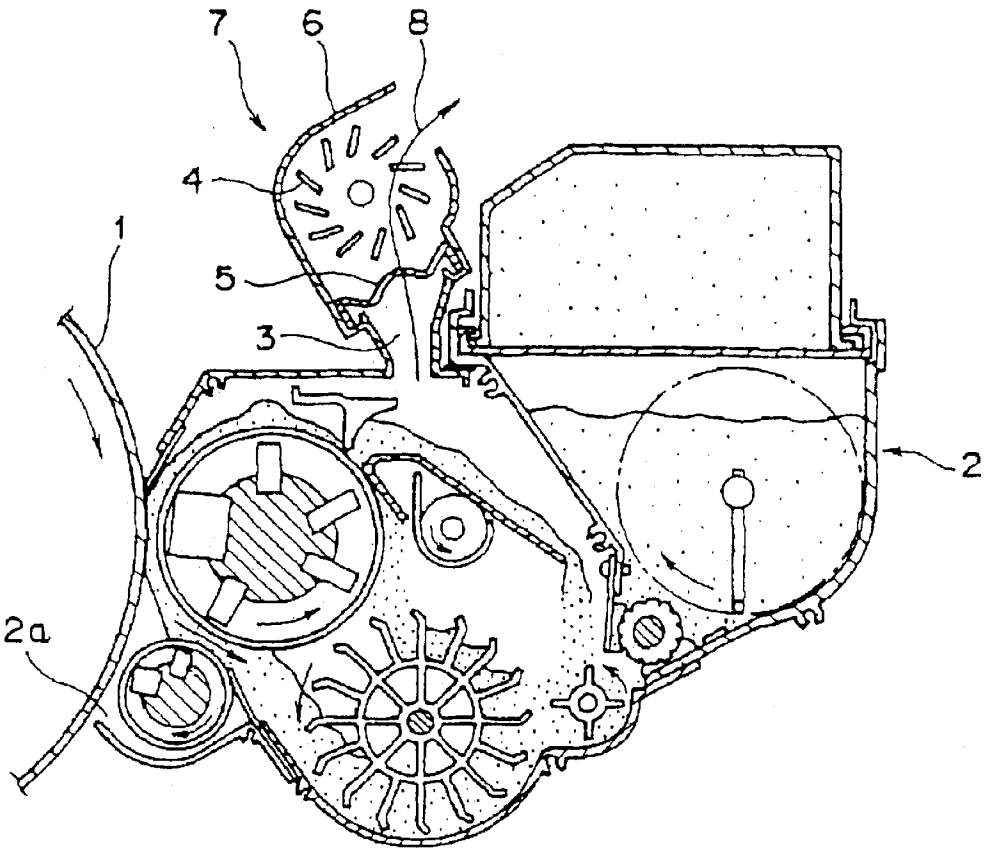
FIG. 1 PRIOR ART
FIG. 1 shows a conventional toner scatter preventing device for a developing device.

To better understand the present invention, brief reference will be made to a conventional toner scatter preventing device, shown in FIG. 1. The toner scatter preventing device to be described is taught in Japanese Patent Laid-Open Publication No. 10-3220 mentioned earlier. As shown, the toner scatter preventing device, labeled 7, is included in an image forming apparatus and includes a filter case 6. A developing device 2 adjoins a photoconductive element or image carrier 1 and is formed with a suction port 3. The filter case 6 on which a fan 4 and a filter 5 are mounted is mounted on the developing device 2 around the suction port 3.

When the fan 4 is driven, it sucks air out of the developing device 2 via the suction portion 3 and discharges it via an exhaust port 8. As a result, air around the drum 1 flows into the developing device 2 via an opening 2*a* for development also formed in the developing device 2, preventing toner from being scattered around via the opening 2*a*. At the same time, the filter 5 collects toner from air flowing toward the exhaust port 8.

A problem with the toner scatter preventing device 7 described above is that toner collected by the filter 5 accumulates on the filer 5 little by little and obstructs the stream of air being sucked by the fan 4, thereby preventing the device 7 from performing the expected operation. Another problem is that the toner accumulating on the filter 5 forms large masses in due course of time and drops into the developing device 2 via the suction portion 3. Such masses of toner deposit on the drum 1 and make the density of a toner image irregular, i.e., lower image quality.

Figure 2:
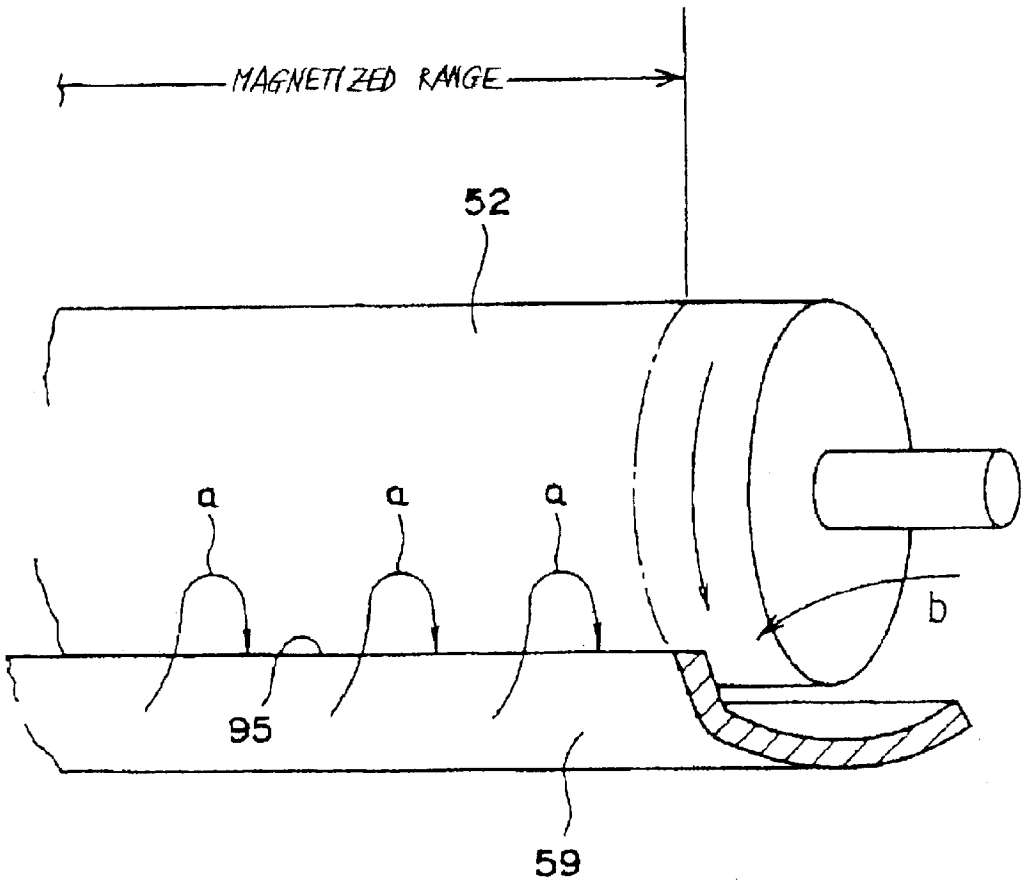
FIG. 2 PRIOR ART
FIG. 2 is a fragmentary isometric view for describing a problem with another conventional toner scatter preventing device.

FIG. 2 shows a toner scatter preventing device disclosed in Japanese Patent Application No. 2001-168354 also mentioned earlier. As shown, air is sucked into a developing device via an opening 95 for development intervening between a developing roller 52 and a case 59, as indicated by arrows a in FIG. 2. At the same time, air around opposite edges of the developing roller 52 turns round into the developing device, as indicated by an arrow b in FIG. 2. In this condition, the stream of air b makes the stream of air a weaker at the opposite edges than at the center with the result that the opposite edges are more contaminated by scattered toner than the center. Although total suction may be intensified, it is difficult to intensity the stream of air at the opposite ends of the developing roller 52.

Figure 3:
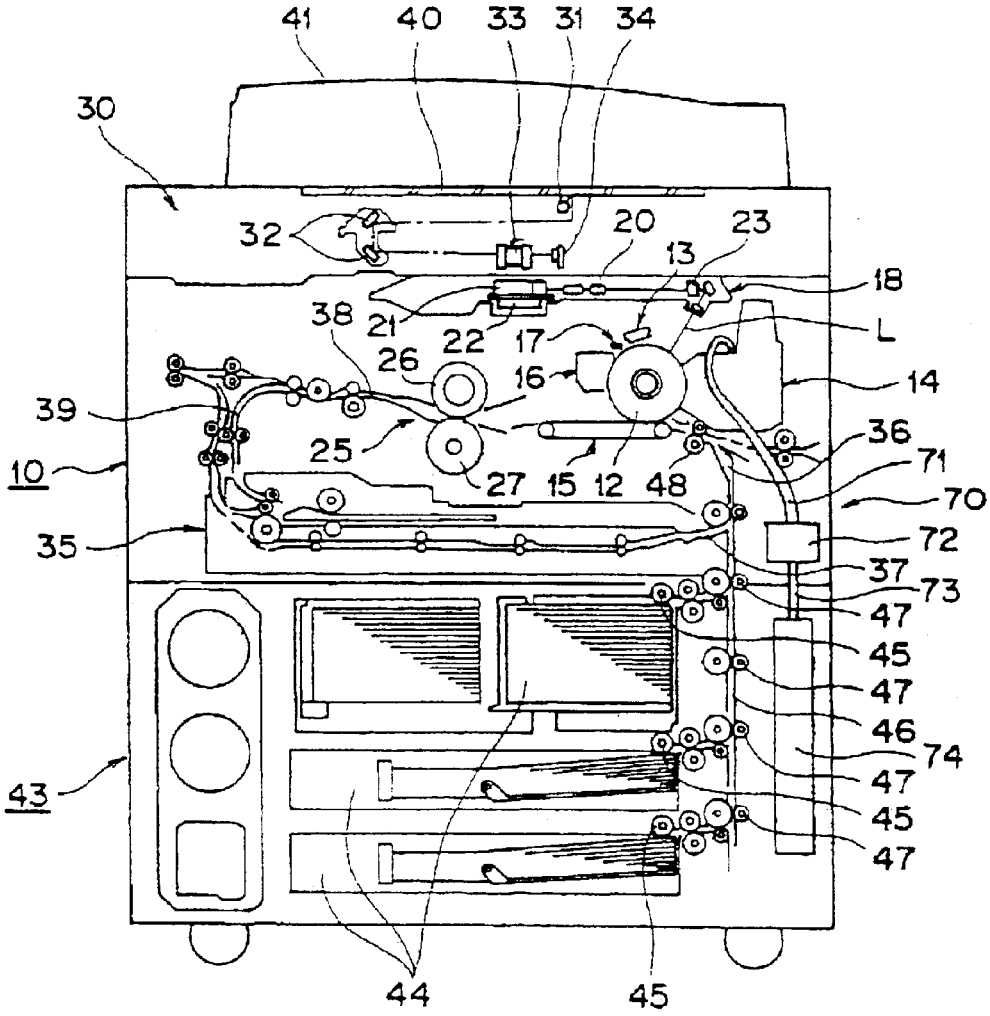
FIG. 3 shows an image forming apparatus embodying the present invention.

Referring to FIG. 3, an image forming apparatus embodying the present invention is shown and implemented as a laser copier by way of example. As shown, the laser copier includes a body or frame 10 in which a photoconductive drum or image carrier 12 is positioned. Arranged around the drum 12 are a charger 13, a developing device 14, a belt unit 12 for image transfer and sheet conveyance, a drum cleaner 16, and a discharger 17.

A laser writing unit or latent image forming means 18 is disposed in the upper portion of the body 10 for forming a latent image on the drum 12. The laser writing unit 18 includes a laser diode or similar light source 20, a polygonal mirror 21, a mirror motor 22 for causing the polygonal mirror 21 to spin, and scanning optics 23 including an f-θ lens.

A fixing device 25 is positioned at the left-hand side of the drum cleaner 16 as viewed in FIG. 3, i.e., downstream of the drum cleaner 16 in a direction in which a sheet or recording medium is conveyed. The fixing device 25 includes a heat roller 26 accommodating an electric heater, halogen lamp or similar heat source and a press roller 27 pressed against the heat roller 26 upward. An image reading device (scanner hereinafter.) 30 is positioned above the laser writing unit 18 and includes a light source 31, a plurality of mirrors 32, a lens 33, and a CCD (Charge Coupled Device) or similar image sensor 34.

A duplex copy unit 35 is arranged in the lower portion of the body 10. A refeed path 37 extends from the duplex copy unit 35 to a path 36 that, in turn, extends to a position below the drum 12. Further, a path 38 extends from the outlet of the fixing device 35 and branches into a turn path 39 terminating at the duplex copy unit 35.

A glass platen 40 is mounted on the top of the body 10 while an ADF (Automatic Document Feeder) 41 is mounted on the body 10 above the glass platen 40. The ADF 41 may be opened away from the glass platen 40, as needed.

The body 10 is mounted on the top of a sheet feeder 43. The sheet feeder 43 includes a plurality of sheet cassettes 44 positioned one above the other and each being loaded with a stack of sheets of a particular size. A pickup roller 45 is associated with the respective sheet cassette 44 and configured to pay out the sheets one by one from the sheet cassette to a path 46, which merges into the path 36. A plurality of roller pairs 47 are arranged on the path 46 for conveying the sheet.

In operation, the operator of the copier stacks documents on the ADF 41 or sets a single document on the glass platen 40 by opening the ADF 41. Subsequently, when the operator presses a start switch, not shown, the image sensor 34 starts reading, on a pixel basis, the document conveyed by the ADF 41 to or manually set on the glass platen 40.

One of the pickup rollers 45 assigned to designated one of the sheet cassettes 44 pays out one sheet to the path 46 in synchronism with the scanning operation of the scanner 30. The sheet is then conveyed by the roller pairs 47 to a registration roller pair 48 via the path 36. The registration roller pair 48 stops the sheet reached its nip and then conveys it toward the image carrier in synchronism with the rotation of the image carrier 12.

When the operator presses the start switch, the image carrier 12 starts rotating clockwise as viewed in FIG. 3. The charger 13 uniformly charges the surface of the drum 12. The laser writing unit 18 scans the charged surface of the drum 12 with a laser beam L in accordance with image data output from the scanner 30, thereby forming a latent image on the drum 12. The developing device 14 develops the latent image with toner to thereby produce a corresponding toner image.

The belt unit 15 transfers the toner image from the drum 12 to the sheet fed from the registration roller pair 48. After the image transfer, the drum cleaner 16 removes toner left on the drum 12, and then the discharger 17 discharges the surface of the drum 12 to thereby prepare it for the next image forming cycle.

The belt unit 15 conveys the sheet carrying the toner image thereon to the fixing device 25. In the fixing device 25, the heat roller 26 and press roller 27 fix the toner image on the sheet with heat and pressure. Subsequently, the sheet or copy is driven out to e.g., a tray, not shown, mounted on the body 10 via the path 38.

In a duplex copy mode for forming toner images on both sides of a sheet, the sheet carrying the toner image on one side thereof is routed through the turn path 39 to the duplex copy unit 35 and reversed thereby. The sheet is then again fed from the duplex copy unit 35 to the position below the drum 12, so that a toner image newly formed on the drum 12 is transferred to the other side of the sheet. After the toner image on the other side of the sheet has been fixed by the fixing device 25, the sheet or duplex copy is driven out to the tray by way of example.

Figure 4:
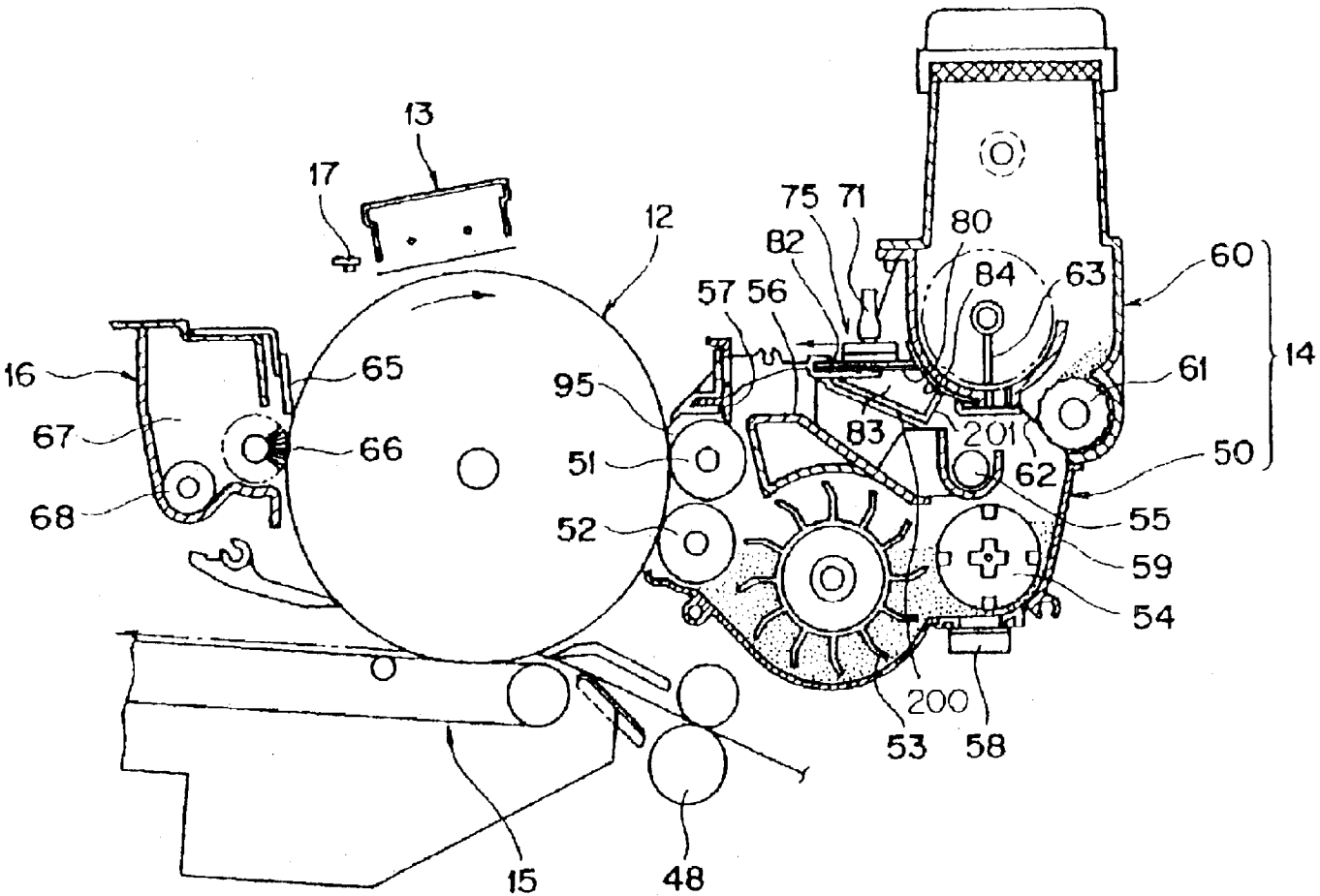
FIG. 4 is a fragmentary view showing essential part of the illustrative embodiment.

FIG. 4 shows a specific configuration of the developing device 14. As shown, the developing device 14 includes a tank 50 and a hopper 60. The tank 50 includes a case 59 accommodating a first and a second developing roller 51 and 52, a paddle wheel 53, a roller or agitator 54, a screw conveyor 55, a separator 56, a doctor blade 57, and a toner content sensor 58. A developer made up of carrier grains and toner grains, i.e., a two-ingredient type developer is stored in the case 59. The hopper 60 stores fresh toner to be replenished and accommodates a toothed replenishing member 61, a metering plate 62, and an agitator 63.

In the specific configuration of FIG. 4, the toner has a weight-mean grain size of 5 $\mu$m to 10 $\mu$m. 60% to 80% of the toner grains in terms of number have a grain size of 5 $\mu$m or below. The carrier has a weight-mean grain size of 65 $\mu$m or below.

Specifically, the toner is made up of resin and colorant although it may additionally contain wax and/or inorganic fine grains. To produce the toner, use may be made of any conventional technology, e.g., pulverization or polymerization.

All kinds of resin known in the art are applicable to the toner. For example, use may be made of one or more of styrene, poly-$\alpha$-styrsyrene or styrene-chlorostyrene copolymer, styrene-propylene copolymer, styrene-butadien copolymer, styrene-vinyl chloride copolymer, styrene-vinyl acetate copolymer, styrene-maleic acid copolymer, styrene-acrylic ester copolymer, styrene-methacrylic ester copolymer, styrene-$\alpha$-chloroacrylic acid methyl copolymer, styrene-acrylonitrilic ester copolymer and other styrene resins (monomers and polymers containing styrene or substitutes thereof), polyester resin, epoxy resin, vinyl chloride resin, rosin-modulated maleic acid resin, phenol resin, polyethylene resin, polyester resin, polypropylene resin, petroleum resin, polyurethane resin, ketone resin, ethylene-ethylacrylate copolymer, xylene resin, and polyvinyl buthyrate resin.

The colorant may be any one of, e.g., carbon black, lamp black, black iron oxide, ultramarine blue, nigrosine, aniline blue, oil black, and azooil black. For the wax, use may be made of, e.g., carnauba wax, rice wax or synthetic ester wax. Further, the inorganic fine grains may be implemented as fine powder of silica or titanium oxide by way of example.

The operation of the developing device 14 shown in FIG. 4 will be described hereinafter. The roller 54 in rotation agitates the developer existing in the case 59 to thereby charge it by friction. The paddle wheel 53 in rotation sends the charged developer upward. Magnets accommodated in the first and second developing rollers 51 and 52 cause the developer sent upward to deposit on sleeves included in the developing rollers 51 and 52. While the sleeves convey the developer toward the drum 12, the doctor blade 57 scrapes off excessive part of the developer. Subsequently, the developer is transferred to the drum 12 by a bias for development, developing a latent image formed on the drum 12.

The toner content of the developer present in the developing device 14 sequentially decreases due to repeated development. When the toner content of the developer decreases below a target value by more than a preselected value, the agitator 63 is rotated to convey the fresh toner to the replenishing member 61 while agitating it. The replenishing member 61 is also rotated to cause the metering plate 62 to oscillate. As a result, the fresh toner is replenished from the hopper 60 to the tank 50 for thereby maintaining the toner content of the developer substantially constant.

The toner content sensor 58 is mounted on the case 59 for sensing the toner content of the developer. The target toner content is set on the basis of the density of an exclusive toner image (P pattern) for measurement formed on the drum 12 and sensed by a photosensor not shown.

An image is, in many cases, not formed on opposite edge portions of a sheet that constitute margins. In light of this, the fresh toner is replenished from the hopper 60 over a preselected replenishing range other than the opposite edge portions, so that the amount of toner does not increase at opposite end portions inside the developing device 14.

Although the toner is electrostatically transferred from the drum 12 to a sheet by the belt unit 15, as stated earlier, about 10% of the toner is left on the drum 12 after the transfer. The residual toner so left on the drum 12 is scraped off by a cleaning blade 65 and a brush roller 66 included in the drum cleaner 16. The toner scraped off is collected in a tank 67 and then conveyed by a screw 68 to one side of the drum cleaner 16. The toner is then delivered to a toner recycling device via an outlet formed in the tank 67.

Referring again to FIG. 3, the illustrative embodiment additionally includes a toner scatter preventing device 70 connected to the developing device 14. The toner scatter preventing device 70 is generally made up of exhausting means 72 disposed in the body 10 and toner storing means 74 disposed in the sheet feeder 43. The exhausting means 72 is fluidly communicated to the developing device 14 by a suction tube 71 while the toner storing means 74 is fluidly communicated to the exhausting means 72 by an exhaust tube 73.

Figure 5:
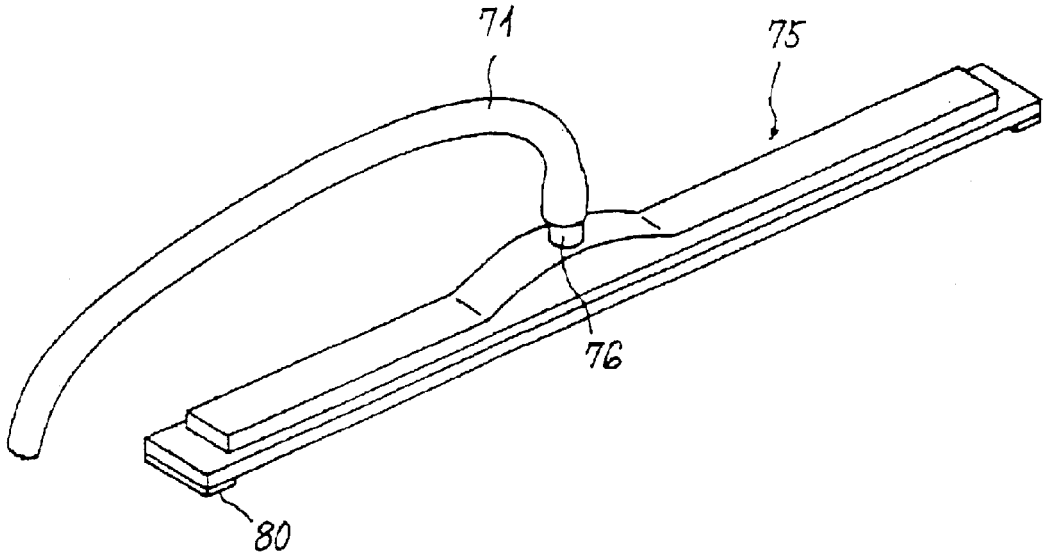
FIG. 5 is an isometric view showing a suction duct included in a toner scatter preventing device unique to the illustrative embodiment.
Figure 6:
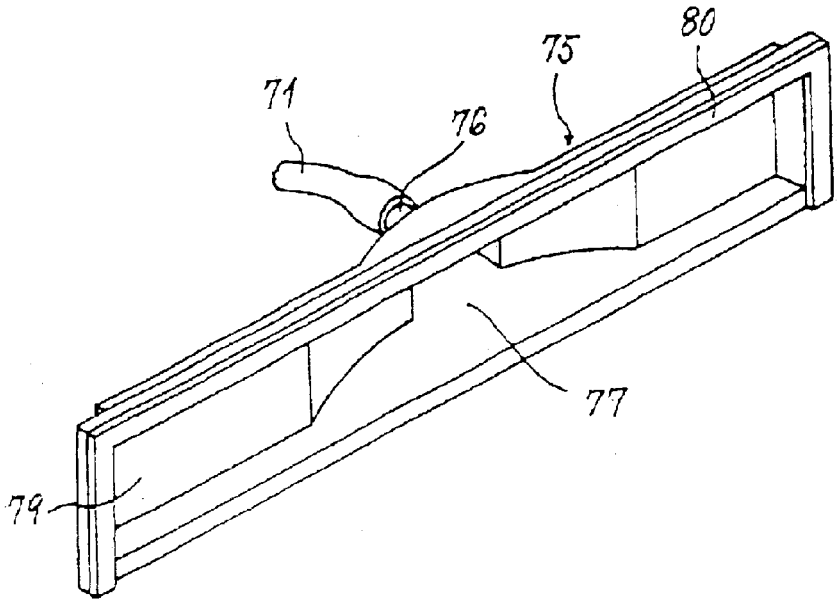
FIG. 6 is an isometric view showing the bottom of the suction duct.

As shown in FIG. 5, a suction duct 75 is affixed to one end of the suction tube 71 remote from the exhausting means 72. The suction duct 75 is elongate and generally rectangular and formed with an opening 76 at its top center. One end of the suction tube 71 is connected to the opening 76. As shown in FIG. 6, the suction duct 75 has at its bottom a sucking portion 79 formed with a wide opening 77. A seal member 80 is adhered to the edges of the bottom of the suction duct 75 around the opening 77 except for the edge adjacent the hopper 60.

As shown in FIG. 4, the case 59 is formed with guide channels 82 facing each other at opposite sides thereof. Opposite ends of the suction duct 75 are inserted into the guide channels 82 in a direction indicated by an arrow in FIG. 4 so as to overlie an opening 83 formed in the case 59. Subsequently, the hopper 60 is mounted to the tank 50 to thereby prevent the suction duct 75 from slipping out of the guide channels 82. A seal member is adhered to the hopper 60 in order to fluidly isolate the hopper 60 from the suction duct 75, thereby fully closing the opening 83 of the case 59. A top case 200 is provided with a partition 201 that partitions the opening 83 from the inside of the developing device. In this configuration, a direct air passage from the suction duct 75 to the inside of the developing device is blocked; only the opening 83 to which the suction duct 75 is communicated forms an exhaust passage from the developing device to the suction duct 75.

Figure 7:
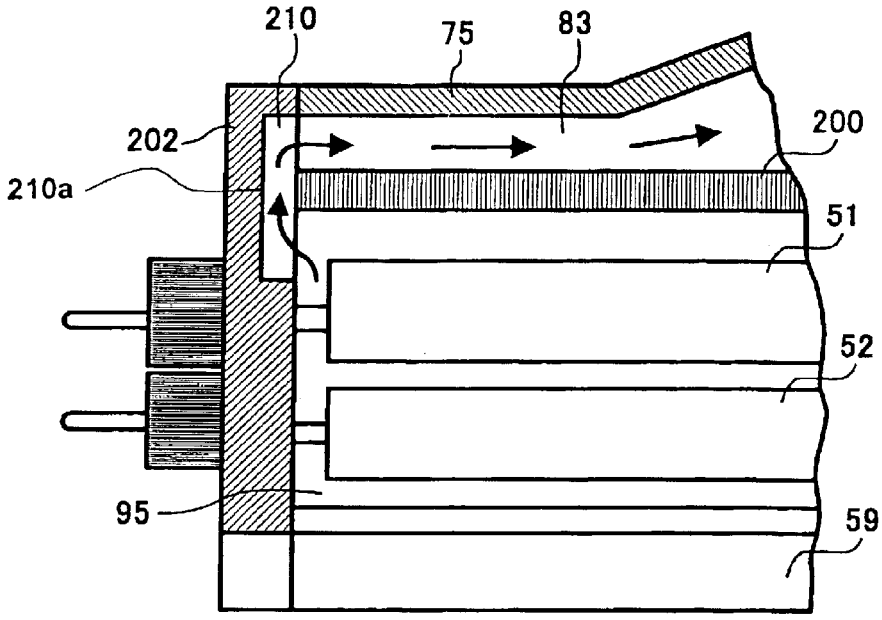
FIG. 7 is a fragmentary section showing a suction port included in the toner scatter preventing device of the illustrative embodiment.
Figure 8:
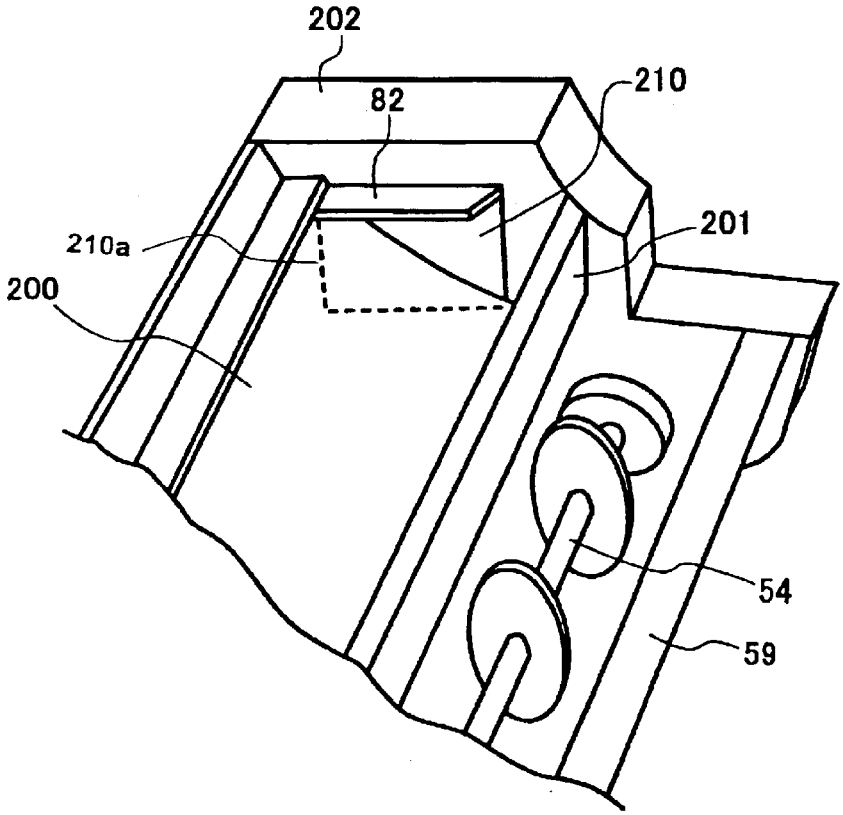
FIG. 8 is a fragmentary perspective view showing the suction port.

As shown in FIGS. 7 and 8, the opening or exhaust passage 83, providing communication between the developing device and the suction duct 75, has two inlets 210 respectively located at positions where the top case 200 and opposite side walls 202 and 203 of the developing device 14 join each other. The side walls 202 and 203 each are formed with a notch 210*a* to form the inlet 210, providing fluid communication between the suction duct 75 and the inside of the developing device 14. The notches 210*a* are positioned outward of the opposite ends of the developing rollers 51 and 52 in the axial direction of the rollers 51 and 52, so that the inlets 210 do not lie in an image forming range. It is to be noted that the side walls 202 and 203 are identical in configuration although only the rear side wall 202 is shown.

Figure 9:
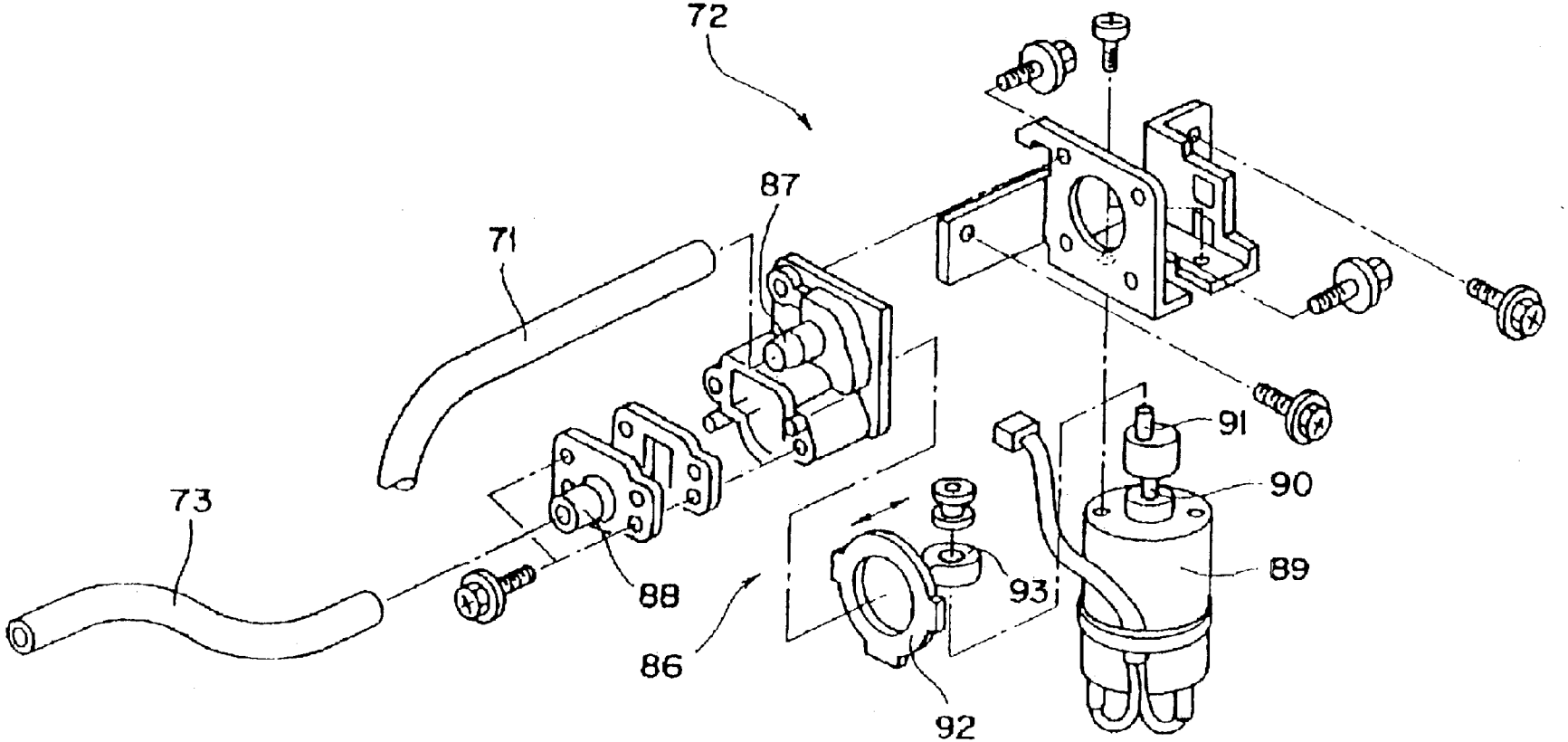
FIG. 9 is an exploded perspective view of exhausting means forming part of the toner scatter preventing means of the illustrative embodiment.
Figure 10B:
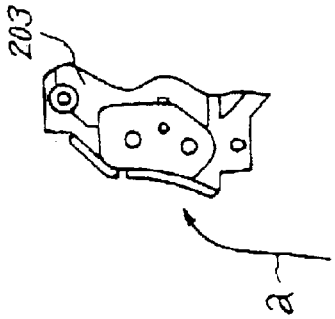
FIG. 10B is a fragmentary side elevation showing a portion around an opening for development included in the developing device of FIG. 10A.
Figure 10A:
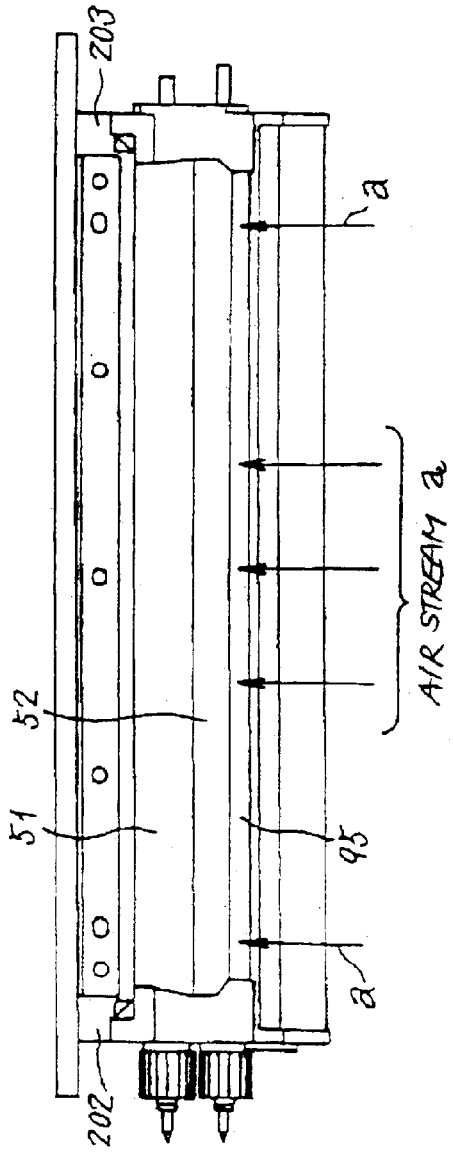
FIG. 10A shows an air stream generated only by the suction of a developing roller included in a conventional developing device.
Figure 10C:
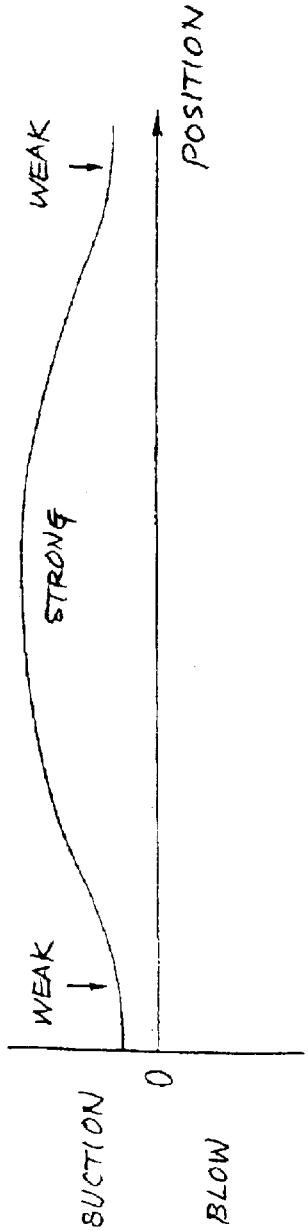
FIG. 10C is a graph showing a relation between a position around the opening for development and the intensity of the air stream.

FIG. 9 shows the exhausting means 72 in an exploded perspective view. As shown, the exhausting means 72 includes a pump 86 including a suction port 87 and a delivery port 88. The other end of the suction tube 71 is connected to the suction port while one end of the exhaust tube 73 is connected to the delivery port 88. A motor 89 has an output shaft 90 on which an eccentric pin 92 is studded. The eccentric pin 91 is fitted in part 93 of a rubber member 92.

In operation, the motor 89 is driven in interlocked relation to a motor assigned to development, not shown, causing the center of the rubber member 92 to move back and forth in a direction indicated by a double-headed arrow in FIG. 9 via the eccentric pin 92. When the rubber member 92 opens a suction valve, not shown, and closes an exhaust valve, not shown, air inside the developing device 14 is sucked into the suction duct 75 via the opening 77 of the sucking portion 79 and then admitted into the pump 86 via the suction tube 71 and suction port 87. On the other hand, when the rubber member 92 closes the suction valve and opens the exhaust valve, air inside the pump 86 is sent to the toner storing means 74 via the exhaust tube 73.

While the developing device 14 is in operation, the exhausting means 72 is continuously driven in order to suck air inside the developing device 14 into the toner scatter preventing device 70, thereby sucking toner flying about in the developing device 14. At the same time, air around the drum 12 is sucked into the developing device 14, forming an air stream in the opening 95 of the case 59, FIG. 4. More specifically, air around the opening 95 is sucked into the developing device 14, as indicated by the arrows a in FIG. 2 specifically. Consequently, the toner is prevented from flying out of the developing device 14.

The developing roller 52 in rotation may cause air around the opening 95 to be sucked into the developing device 14 without resorting to the toner scatter preventing device 70. However, the device 70 causes more air to be sucked into the developing device 14 via the opening 95 for thereby obviating the scatter of the toner more positively.

Ideally, air should be uniformly sucked by the developing roller 52 in rotation in the axial direction of the roller 52. However, as shown in FIG. 2 and FIGS. 10A through 10C, the developing rollers 51 and 52 do not convey the developer outside of their magnetized range, so that portions where an air stream is not produced exist. This, coupled with the air streams b turning round via the end portions of the unit, tends to make the air stream a weak.

In light of the above, in the illustrative embodiment, the inlets 210, FIG. 7, of the opening or exhaust passage 83 inside the developing device 14 are positioned outside of the image forming range or toner replenishing range. In this configuration, air is directly sucked via both end portions of the opening 95 where the air stream generated by the developing rollers 51 and 52 is weak. This successfully intensifies the air stream at both end portions of the opening 95 for thereby protecting them from contamination.

Figure 11:
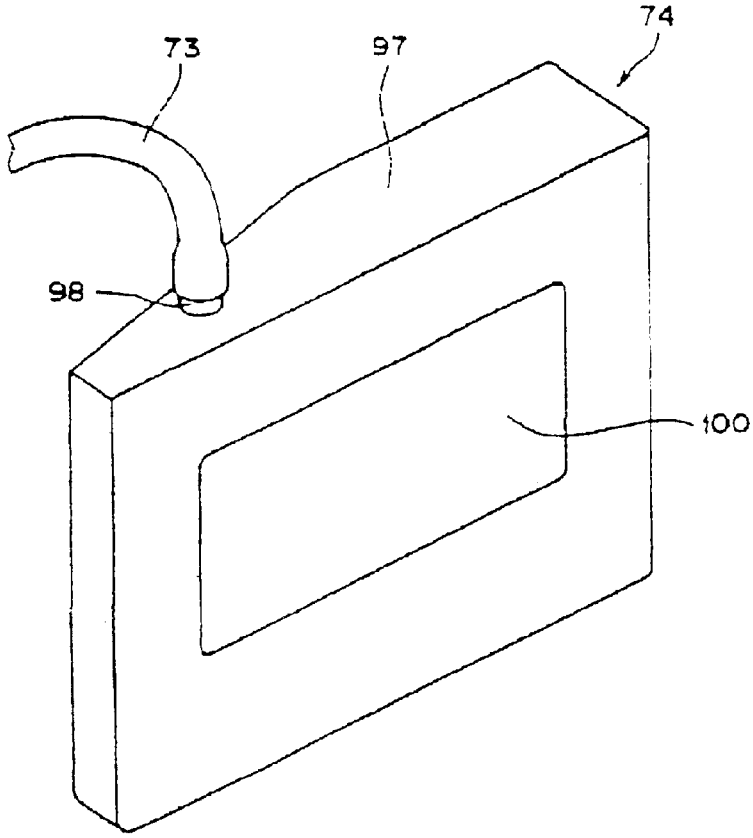
FIG. 11 is an isometric view showing a specific configuration of toner storing means forming another part of the toner scatter preventing means of the illustrative embodiment.

FIG. 11 shows a specific configuration of the toner storing means 74. As shown, the toner storing means 74 is implemented as a tank 97 having a substantial width, a substantial height, and a small depth. As shown in FIG. 3, the tank 97 is positioned in the sheet feeder 43 outside of the path 46. The other end of the exhaust tube 73 is connected to an inlet 98 formed in the top of the tank 97. An opening is formed in the outside surface of the tank 97 at a slightly high position. Relatively large, filter-like toner collecting means 100 is fitted on the tank 97 to close the opening of the tank 97.

The toner collecting means 100 is provided with a fine open-cell structure produced by stretching PTFE (polytetrafluoroethylene), which is chemically more stable than the other fluorocarbon resins, by a special technology. With such a structure, the toner collecting means 100 passes air, but collects the toner and stores it in the tank 97. It is noteworthy that the toner collecting means 100 implemented by stretched PTFE does not cause the toner to leak like an electrostatic filter or similar filter and can surely collect the toner even when air under pressure is passed therethrough. Air from which the toner has been collected by the toner collecting means 100 is discharged to the outside of the body 10 via an exhaust grill not shown.

The toner storing means 74 additionally includes sensing means responsive to the full state of the tank 97. When the sensing means determines that the tank 97 is filled up with the toner, the tank 97 is emptied or replaced with a new tank.

Figure 12:
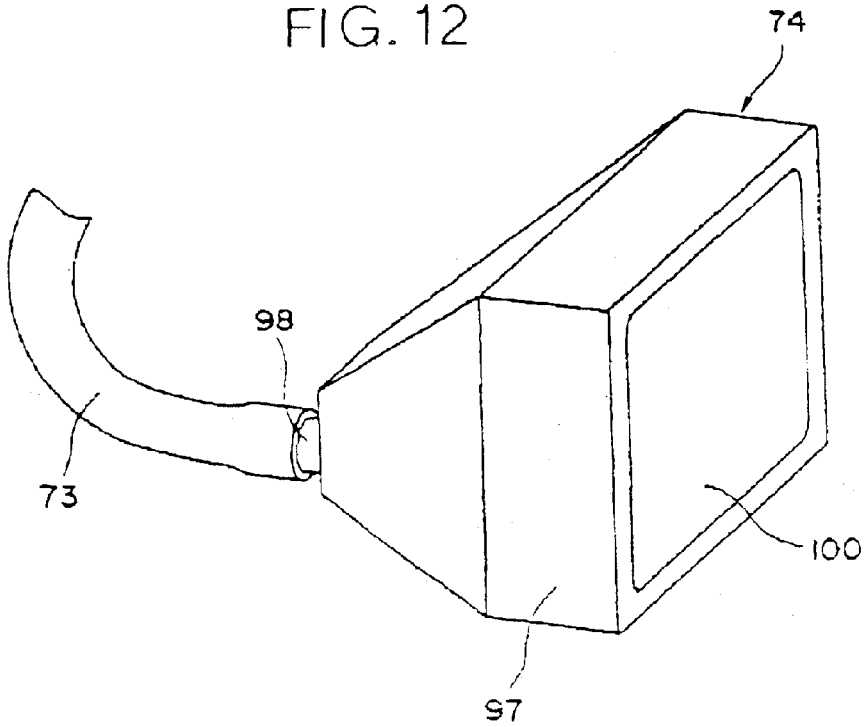
FIG. 12 is an isometric view showing another specific configuration of the toner storing means.

FIG. 12 shows another specific configuration of the toner storing means 74. In FIG. 12, structural elements identical with the structural elements shown in FIG. 11 are designated by identical structural elements and will not be described specifically in order to avoid redundancy. The crux is that the opening of the tank 97 and toner collecting means 100 closing it should be as large as possible.

Of course, the suction tube 71 and exhaust tube 73 constituting the exhaust passage may be replaced with pipes by way of example.

Figure 13:
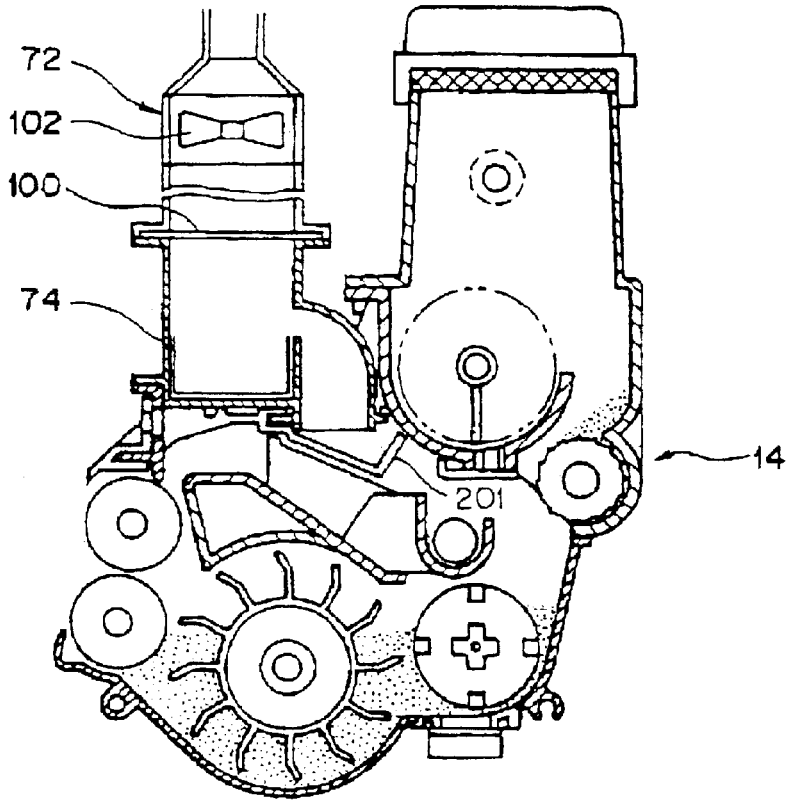
FIG. 13 shows a modification of the toner scatter preventing means of the illustrative embodiment.

FIG. 13 shows a modification of the illustrative embodiment. In the embodiment described above, the toner storing means 74 and toner collecting means 100 are arranged downstream of the exhausting means 72 in the direction of air flow. In the modification of FIG. 13, the toner storing means 74 and toner collecting means 100 are arranged upstream of the exhausting means in the above direction. In this configuration, the toner collected by the toner collecting means 100 is received by the toner storing means 74, which resembles a tray, without being dropped into the toner stored in the developing device 14. In FIG. 13, the toner storing means 74 can be removed to discard the stored toner, promoting easy handling of the toner collected by the toner collecting means 100.

In the configuration of FIG. 13, the toner collected by the toner collecting means 100 is stored in the toner storing means 74 upstream of the toner collecting means 100, so that the toner does not reach the exhausting means 72 downstream of the toner collecting means 100. The exhausting means 72 may therefore have any suitable configuration, e.g., one using a fan 102 in consideration of cost, size, and easiness of assembly.

Figure 14:
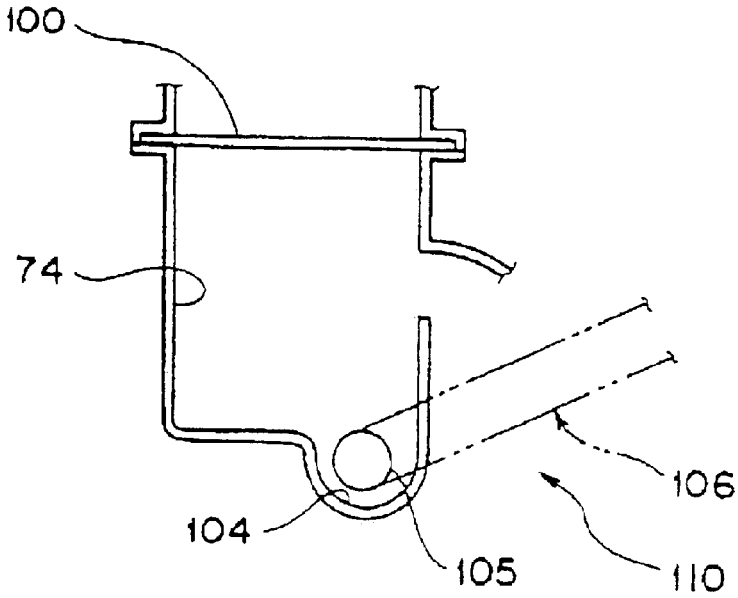
FIG. 14 shows another modification of the toner scatter preventing means of the illustrative embodiment.

Further, as shown in FIG. 14, the toner scatter preventing means 70 may include toner recycling means 110 so as not to discard the collected toner. As shown, the toner recycling means 110 includes a recess 105 formed in the toner storing means 74 for collecting the toner. A screw conveyor or similar toner conveying member 105 is positioned in the recess 105 and configured to convey the toner to one side of the recess 105. A screw, belt, coil or similar toner collecting member 106 returns the toner brought to one side of the recess 105 to, e.g., the developing device 14. The toner recycling means 110 allows the collected toner to be reused for thereby reducing maintenance cost.

In the illustrative embodiment and modifications thereof, the toner, used in combination with the carrier having a small grain size, is collected in a smaller amount than conventional, so that the time when the toner collecting means 10 is to be stopped up is delayed. In addition, the time when the toner storing means or tank 64 is to be filled up is delayed. More specifically, when the toner with a small grain size is mixed with the carrier with a small grain size, the surface area of the carrier for a unit weight becomes greater than the surface area of the conventional carrier, resulting in a decrease in the carrier covering ratio of the toner. Consequently, the probability that the toner contacts the carrier increases, protecting the toner from defective charging. It follows that the ratio of toner deposition on the carrier increases, causing a minimum of toner to fly out of the developing device.

Figure 15:
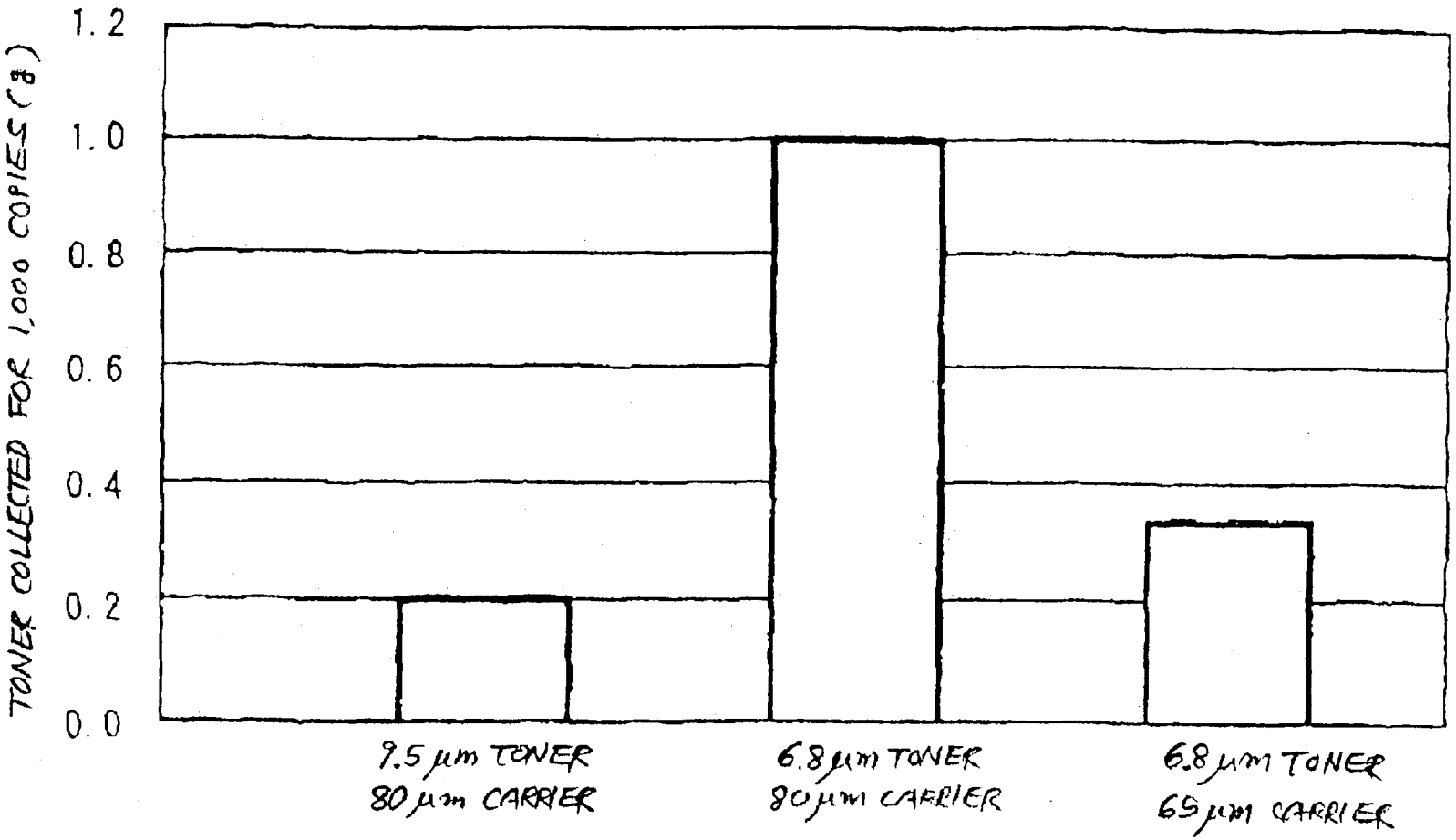
FIG. 15 is a graph showing a relation between the grain sizes of toner and carrier and the amount of toner collected.

FIG. 15 shows the results of experiments that I conducted to determine a relation between the grain sizes of toner and carrier and the amount of toner collected. As shown, when toner with a small grain size necessary for high image quality was used in combination with a carrier with small grain size, there were realized both of an improvement in image quality and a decrease in the amount of collected toner.

While the illustrative embodiment includes the toner storing means 64, the developing device shown in FIG. 1 may also be provided with suction ports outside of the image forming range.

In summary, it will be seen that the present invention provides an image forming apparatus in which air streams at both ends of a developing device can be intensified to thereby protect opposite ends of an opening formed in the developing device from contamination. Further, because air inlets are positioned outside of the image forming range of the developing device, the air streams at both end portions of the opening can be intensified even when an air sucking ability is lowered due to the resistance of exhaust that occurs in toner storing means.

Various modifications will become possible for those skilled in the art after receiving the teachings of the present disclosure without departing from the scope thereof.

What is claimed is:

1. A toner scatter preventing device comprising:

a developing device having an exhaust passage extending from a first lateral side to a second lateral side, said exhaust passage in flow communication with a pair of suction ports, one of said suction ports located at each lateral side of said developing device, said suction ports positioned outside an image forming width of said developing device, said exhaust passage located proximate a top surface of said developing device;

a duct connected to an opening in said top surface of said developing device, said opening in flow communication with said exhaust passage;

exhausting means configured to draw air from each of said suction ports into said duct; and toner collecting means.

2. The apparatus recited in claim 1 further comprising a filter configured to prevent toner from reaching said exhausting means.

3. The apparatus recited in claim 2 wherein said toner collecting means comprises a tray arranged to collect said toner, said tray located above said exhaust passage.

4. The apparatus recited in claim 3 further comprising toner recycling means, said toner recycling means configured to transport toner from said tray to a toner hopper of said developing device.

5. The apparatus recited in claim 4 wherein said toner has a weight-mean grain size of 5 $\mu$m to 10 $\mu$m while 60% to 80% of said toner in terms of number has a grain size of 5 $\mu$m or below.

6. The apparatus recited in claim 5 wherein said toner collecting means is removable.

7. The apparatus recited in claim 6 wherein said toner collecting means comprises stretched PTFE.

8. The apparatus recited in claim 1 wherein said toner collecting means comprises a tray arranged to collect said toner, said tray located above said exhaust passage.

9. The apparatus recited in claim 8 further comprising toner recycling means, said toner recycling means configured to transport toner from said tray to a toner hopper of said developing device.

10. The apparatus recited in claim 1 wherein said toner collecting means is arranged downstream of said exhausting means.

11. The apparatus recited in claim 1 wherein said toner has a weight-mean grain size of 5 $\mu$m to 10 $\mu$m while 60% to 80% of said toner in terms of number has a grain size of 5 $\mu$m or below.

12. The apparatus recited in claim 1 wherein said toner collecting means is removable.

13. The apparatus recited in claim 1 wherein said toner collecting means comprises stretched PTFE.

* * * * *